United States Patent [19]

Geller et al.

[11] 4,417,178

[45] Nov. 22, 1983

[54] PROCESS AND APPARATUS FOR PRODUCING HIGHLY CHARGED LARGE IONS AND AN APPLICATION UTILIZING THIS PROCESS

[76] Inventors: Richard Geller, 4, place Grenette, 3800 Grenoble; Francis Gugliermotte, 1, boulevard Jomardiere, 38120 Saint Egreve, both of France

[21] Appl. No.: 458,645

[22] Filed: Jan. 17, 1983

Related U.S. Application Data

[63] Continuation of Ser. No. 229,178, Jan. 28, 1981, abandoned.

[30] Foreign Application Priority Data

Feb. 13, 1980 [FR] France ..... 80 03153

[51] Int. Cl.[3] ..... H01J 7/24

[52] U.S. Cl. ..... 315/111.81; 250/427; 313/231.31; 313/362.1; 315/111.01; 315/111.41

[58] Field of Search ..... 315/111.81, 183, 111, 315/111.4; 256/427; 313/231.3, 362.1

[56] References Cited

U.S. PATENT DOCUMENTS

| | | | |
|---|---|---|---|
| 3,105,899 | 10/1963 | Gunther et al. | 313/363.1 |
| 3,778,656 | 12/1973 | Fremiot | 313/361.1 |
| 3,778,658 | 12/1973 | Harris . | |
| 3,898,496 | 8/1975 | Hudson et al. | 313/362.1 |
| 4,045,677 | 8/1977 | Humphries et al. | 313/111.81 |
| 4,206,383 | 6/1980 | Anicich | 313/362.1 |

*Primary Examiner*—Harold Dixon

*Attorney, Agent, or Firm*—Frishauf, Holtz, Goodman & Woodward

[57] ABSTRACT

Process for producing highly charged ions making it possible to ionize a gas of neutral atoms by electron impact, the gas being introduced into an ultra-high frequency cavity excited by at least one high frequency electromagnetic field which is associated with a magnetic field, whose amplitude is selected in such a way that the electronic cyclotron frequency associated with said magnetic field is equal to the frequency of the electromagnetic field also established in the cavity, the latter being provided with an opening for the extraction of ions by means of appropriate electrodes, wherein the said magnetic field is constituted by superimposing of a multipole radial magnetic field having a minimum amplitude in the central part of the cavity and a rotationally symmetrical axial magnetic field having a gradient along said axis, the resulting magnetic field being regulated in such a way that in the cavity there is at least one completely closed magnetic layer having no contact with the cavity walls, whereby on said layer the electronic cyclotron resonance condition is satisfied so as to obtain an ionization of the gas passing through it, the ions formed then being extracted through the extraction opening positioned in the vicinity of the outermost layer by means of extraction electrodes having no contact with said layer, followed by selection using appropriate means.

Application to obtaining ions highly charged with rare gases.

5 Claims, 2 Drawing Figures

PROCESS AND APPARATUS FOR PRODUCING HIGHLY CHARGED LARGE IONS AND AN APPLICATION UTILIZING THIS PROCESS

This is a continuation, of application Ser. No. 229,178 filed Jan. 28, 1981, now abandoned.

The present invention relates to a process for producing highly charged large ions and to an apparatus and application utilizing said process.

More specifically, the invention relates to a process and an apparatus making it possible to create and produce from large or heavy atoms, i.e. having more than two electrons, highly charged large ions, i.e. atoms which have lost all their electrons, including those of the deep layers. These atoms can be neutral or preionized. The highly charged ions are used for measuring physical constants and are in particular intended for equipping particle accelerators, used in both the scientific and medical fields.

It is known that ions can be obtained from a gas or a metal vapour containing neutral atoms ionized by ionizing electron impacts.

Obviously, there are a certain number of processes and apparatuses or sources making it possible to obtain ions, e.g. arc sources, confinement sources, electronic cyclotron resonance sources, etc.

The quantity of ions which can be produced by these different sources results from the competition between two processes:

the formation of ions by ionization in successive electron layers of the neutral atom;

The destruction of the same ions by simple or multiple recombination during a collision with a neutral atom obtained from not yet ionized gas or produced on the wall of the apparatus when an electrified particle strikes said wall.

Therefore, the problem is that of avoiding the destruction of these ions by preventing any collision with a neutral atom. Obviously, the quantity of neutral atoms can be reduced by using conventional pumps to produce a high vacuum in said sources, but this does not lead to the total disappearance of said neutral atoms.

In addition, the particles from these sources are not 100% ionized, i.e. the atoms do not lose all their electrons. To continue the ionization of these atoms, the ions are passed onto a thin sheet with a thickness of a few microns after having been accelerated or onto a target formed by an electron plasma. These processes making it possible to obtain high charged ions are to a greater or lesser extent complex and consequently costly.

BRIEF SUMMARY OF THE INVENTION

The present invention therefore relates to a process and apparatus for producing highly charged ions making it possible to obviate in simple manner the said disadvantages, whilst in particular permitting an almost total ionization of the neutral atoms supplied by the gas to be ionized, as well as the residual neutral atoms, even after producing a high vacuum.

The invention also relates to an application utilizing this process.

The present invention therefore relates to a process for producing highly charged ions making it possible to ionize a gas of neutral atoms by electron impact, the gas being introduced into an ultra-high frequency cavity excited by at least one high frequency electromagnetic field which is associated with a magnetic field, whose amplitude is selected in such a way that the electronic cyclotron frequency associated with said magnetic field is equal to the frequency of the electromagnetic field also established in the cavity, the latter being provided with an opening for the extraction of ions by means of appropriate electrodes, wherein the said magnetic field is constituted by superimposing of a multipole radial magnetic field having a minimum strength in the central part of the cavity and a rotationally symmetrical axial magnetic field having a gradient along said axis, the resulting magnetic field being controlled in such a way that in the cavity there is at least one completely closed magnetic layer (i.e. shell of substantially uniform field strength) having no contact with the cavity walls, whereby on said layer the electronic cyclotron resonance condition is satisfied so as to obtain an ionization of the gas passing through it, the ions formed then being extracted through the extraction opening positioned in the vicinity of the outermost layer by means of extraction electrodes having no contact with said layer, followed by selection using appropriate means.

The association within an ultra-high frequency cavity of a high frequency electromagnetic field and an axial magnetic field, whose amplitude is selected in such a way that the electronic cyclotron frequency associated with said field is equal to the frequency of the electromagnetic field permits a high ionization of the neutral atoms. The electrons emitted are highly accelerated as a result of the electronic cyclotron resonance. Further detailed information on electron cyclotron resonance can be obtained from French Patent No. 71 27812 issued on an application filed on July 29, 1971 by the Commissariat à l'Energie Atomique and entitled "Ion sources using an ultra-high frequency cavity" and corresponding to U.S. Pat. No. 3,778,656.

The superimposing of a multipole radial magnetic field having a minimum amplitude in the central part of the ultra-high frequency cavity on an axial magnetic field makes it possible to confine the ions formed as soon as they enter the closed-shell magnetic layer and consequently the density of neutral atoms in the confinement region and of the electrons is reduced, i.e. the ions and electrons which have left said layer as a result of impact with a neutral or already ionized atom are brought both into the said layer. As a result of this confinement the electrons have the time to bombard the same atom a number of times and to completely ionize it. To recover the energy lost in the successive ionizations of an atom, the electron must again pass through the resonating layer, which must not be interrupted. This resonating layer prevents the neutral atoms from penetrating to the centre of said layer. Therefore, the extraction of the multicharged ions can take place in the vicinity of the layer, which constitutes an in situ ion pumping surface.

Moreover, the fact that the number of neutral atoms present within the layer is very low makes it possible to considerably reduce the effects of recombinations by charge exchange between a neutral atom and a highly ionized atom and makes it possible to maintain high charge states for the ions.

According to another feature of the invention the apparatus making it possible to realise the process comprises at least one gas source, an ultra-high frequency cavity connected to vacuum pumps and provided with an opening permitting the extraction of ions, means for producing the axial magnetic field and means for producing the radial magnetic field distribution over the entire surface area of the cavity, means for introducing the electromagnetic field into the multimode cavity, electrodes for the extraction of the ionized gas and means for the selection of the ions.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBOIDMENTS

Figure 1:
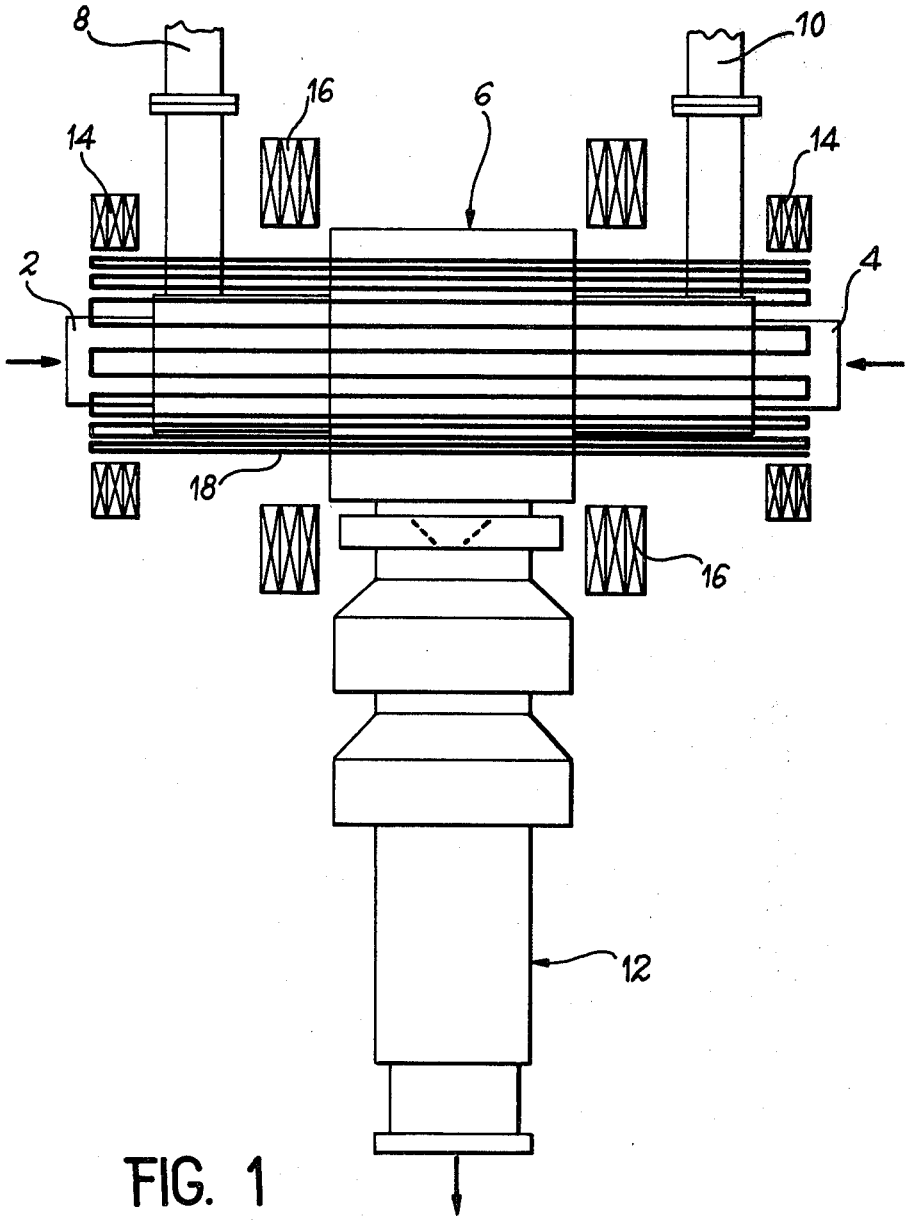
FIG. 1 diagrammatically, the apparatus permitting the realisation of the process according to the invention.

In FIG. 1, two not shown sources make it possible to pass a preionized or non-preionized ionizable gas into pipes 2 and 4 leading to a confinement enclosure 6 constituting an oscillating cavity in a discrete mode or a high order multimode, i.e. of large size compared with that of the wavelength of the electromagnetic field. This electromagnetic field is introduced by waveguides such as 8 and 10 which can have a circular or rectangular cross-section.

Cavity 6, which can have a random shape, is connected by means of a pipe 12 to a not shown, known vacuum pump (diffusion pump, turbomolecular drag pump, cryogenic pump, etc) making it possible to create a high vacuum and continuously extract the ions. Pipes 2 and 4, as well as cavity 6, are surrounded by pairs of axial coils such as 14 and 16 able to produce the axial magnetic field which, by superimposition on the high frequency electromagnetic field, permits the electronic cyclotron resonance.

The electrons and ions are confined by means of a multipole radial magnetic field having a zero strength in the centre of the cavity which can be created by means of cylindrical bars 18 arranged parallel to one another, connected together in meander fashion and capable of being put into a superconducting state. They are placed in cylindrical protective tubes carrying the cooling liquid which is at a sufficiently low temperature to enable the liquid to optionally be integrated into a cryogenic pumping system by condensation or titanium vapour. Part of these bars 18 traverses the multimode cavity 6.

It is obviously also possible to use any other method for obtaining magnetic fields, particularly permanent magnets. In the case of the radial magnetic field, the magnets can be placed in cylindrical protective tubes submerged in the vacuum or can be positioned externally of cavity 6.

Figure 2:
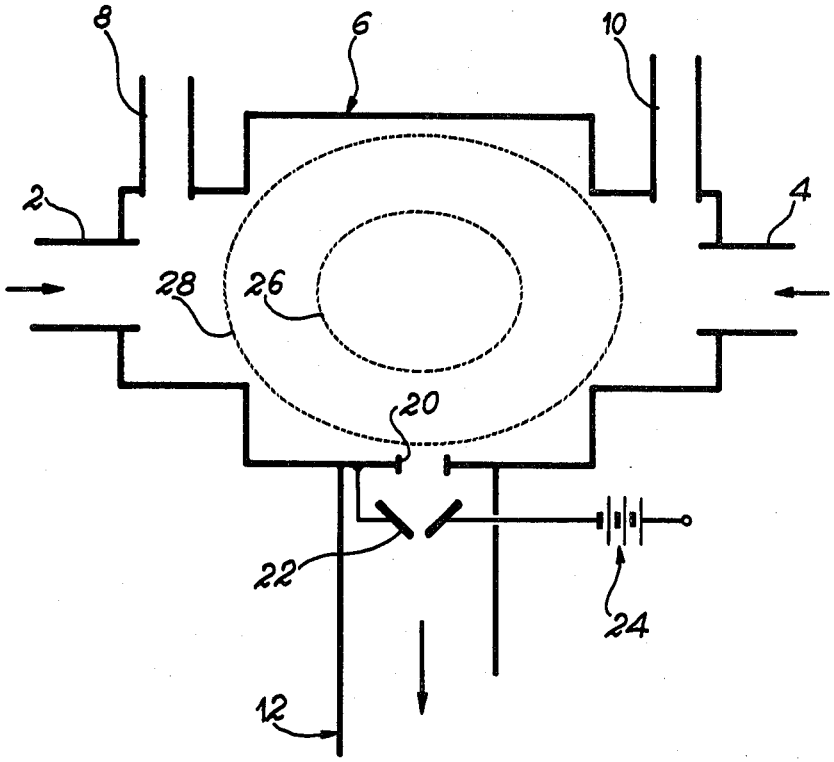
FIG. 2 diagrammatically, part of the apparatus of FIG. 1.

FIG. 2 diagrammatically shows the inner part of the apparatus and in particular the ultra-high frequency cavity 6. This cavity is provided with an opening 20 through which the ions formed can be extracted. The ions can be extracted from cavity 6 by means of electrodes 22 between which is created a negative potential difference by means of a power supply 24. The ions extracted in this way from cavity 6 are selected as a function of their degree of ionization with the aid of any known means using an electrical and/or magnetic field. FIG. 2 shows two completely closed resonating layers 26, 28 having no contact with cavity 6.

In the case of a single electromagnetic field injected by waveguides 8 and 10, the internal layer 26 corresponds to the resonating layer in such a way that the electronic cyclotron frequency is equal to the electromagnetic field frequency, whilst the external layer 28 corresponds to a layer resonating on one harmonic, e.g. the electronic cyclotron frequency is equal to twice the electromagnetic field frequency.

In the case of two electromagnetic fields of different frequency, the inner resonating layer 26 is associated with the electromagnetic field having the lowest frequency, whilst the outer resonating field 20 is associated with the electromagnetic field having the highest frequency.

In the case of two layers, the inner layer essentially serves for the forced ionization of the gas, whilst the outer layer preserves the ionization state of the ions extracted at said second layer. In the case of only one resonating layer, the ionization and extraction take place at said layer.

By placing the extraction opening 20 in the vicinity of the layer, but without there being any contact between layer and opening, makes it possible to reduce to the greatest possible extent the travel of the ions, whilst reducing the possibilities of recombination with one or more electrons which have lost their energy during a preceding encounter with an atom of the gas to be ionized or with a residual neutral atom. The presence of neutral atoms is limited by creating a high vacuum (below $10^{-5}$ Torr) in the enclosure. As the layer is not in contact with the inner wall of the cavity or any other wall (extraction electrode) any possibility of recombination of a neutral atom by impact of an ion against the wall is avoided, as is the loss of confined electrons and ions.

The resonating layers are shown in oval form, but obviously the shape thereof is modified by the shape of the conductors creating the radial magnetic field.

Either the radial magnetic field or the axial magnetic field or both may be a pulsed field instead of a field that is maintained substantially constant.

This apparatus makes it possible to obtain highly charged large ion beams, i.e. atoms which have lost several or all their electrons. For this purpose, the high frequency power transported by the electromagnetic field must be adequate. For a 1 liter cavity, a high frequency power above 1 kW is necessary for maintaining the atoms under a high ionization state, as well as for the extraction of said ions. In the case of large cavities, the power necessary for the ionization and extraction of the ions can be supplied by an electromagnetic field injected into the cavity by means of several waveguides or by several electromagnetic fields. It should be noted that the waveguides permitting the injection of the electromagnetic field are provided with gas-tight dielectric windows, but which are transparent to the electromagnetic power.

In particular, this apparatus makes it possible to obtain ion beams highly charged with rare gases such as e.g. beams of the $Ne^{+10}$, $AR^{+13}$ and $Xe^{+33}$ beams, but also $C^{6+}$, $N^{7+}$, etc.

In the case of a practical realisation of the process for an axial field between 3000 and 5000 Gauss and a radial field varying from 0 to 5000 Gauss a frequency between 10 and 14 gigahertz is selected in the case of the electromagnetic field.

What is claimed is:

1. A process for producing highly charged ions comprising the steps as follows:

introducing a gas of neutral atoms into an ultra-high frequency cavity having electrically conducting walls enclosing an interior space and means for maintaining a vacuum therein, said cavity having an axis passing therethrough between the wall portions thereof;

exciting said cavity by at least one ultra-high frequency electromagnetic field having a given frequency, applying to said cavity a multipole radial magnetic field having a minimum value in a central part of said cavity and an axial magnetic field having a gradient along said axis, said gradient being such as to inhibit ions from proceeding from the midportion of the interior of said cavity to at least one of said end wall portion of said cavity, said magnetic fields forming a resultant magnetic field having a value corresponding to a given electronic cyclotron frequency in the interior of said cavity, modifying the value of said resultant magnetic field in such a way that in said cavity there is at least one closed shell of substantially uniform magnetic field strength having no contact with said cavity walls, while at said shell said electronic cyclotron frequency is equal to said frequency of said exciting electromagnetic field, whereby ions and electrons are produced by ionization of the gas passing through said shell and said electrons and said ions are substantially confined in a zone defined within said shell, extracting said ions by means of electrodes at an exit from said cavity positioned in the vicinity of said shell and having no contact with said shell, and selectively sorting said ions with reference to their charge.

2. A process according to claim 1, wherein the electromagnetic field has a power related to the unit volume of the ultra-high frequency cavity exceeding kilowatt per liter.

3. A process according to claim 1 wherein at least one of the axial and radial magnetic fields is continuous.

4. A process according to claim 1 wherein at least one of the axial and radial magnetic fields is pulsating.

5. Apparatus for electrically producing highly charged ions comprising:

a cavity having electrically conducting walls and an axis passing through the middle of said cavity between end wall portions thereof and enclosing an interior space for excitation therein of an ultra-high frequency (UHF) electromagnetic field pattern, said interior space being sufficient for said electromagnetic field pattern to exceed a half wave length of the excitation wave in every dimension of said cavity;

means for supplying UHF electromagnetic energy for excitation of said field pattern in said cavity;

means for evacuating said cavity and maintaining it at high vacuum;

means for introducing a gas of neutral atoms into said cavity at low pressure;

means for applying an axial magnetic field to the interior space of said cavity which has a gradient, along said axis, such as to inhibit ions in the midportion of the interior of said cavity from proceeding to at least one of said end wall portions thereof;

means for applying a multipolar radial magnetic field to the interior of said cavity, which multipolar field has a minimum value in the middle of said cavity, the radial directions of the poles of said multipolar field being referred to the axis of said cavity;

means associated with said evacuation means for extracting highly charged ions from said cavity, and means for sorting the extracted highly charged ions according to their respective chargers.

* * * * *

UNITED STATES PATENT AND TRADEMARK OFFICE

CERTIFICATE OF CORRECTION

PATENT NO. : 4,417,178

DATED : November 22, 1983

INVENTOR(S) : Richard GELLER et al

It is certified that error appears in the above-identified patent and that said Letters Patent is hereby corrected as shown below:

On the abstract page of the patent, under Item 76, lines 2 and 3, replace the name of"Francis Gugliermotte" with --Bernard Jacquot--.

Signed and Sealed this

*Twenty-second* Day of *April 1986*

[SEAL]

*Attest:*

DONALD J. QUIGG

*Attesting Officer*

*Commissioner of Patents and Trademarks*